US007614438B2

(12) United States Patent
Yu et al.

(10) Patent No.: US 7,614,438 B2
(45) Date of Patent: Nov. 10, 2009

(54) VENETIAN BLIND

(75) Inventors: Fu-Lai Yu, Taipei Hsieh (TW); Chin-Tien Huang, Taipei Hsieh (TW); Shun-Chi Yu, Taipei Hsieh (TW)

(73) Assignee: Teh Yor Co., Ltd. (TW)

( * ) Notice: Subject to any disclaimer, the term of this patent is extended or adjusted under 35 U.S.C. 154(b) by 1015 days.

(21) Appl. No.: 11/070,126

(22) Filed: Mar. 1, 2005

(65) Prior Publication Data

US 2005/0211393 A1 Sep. 29, 2005

Related U.S. Application Data

(63) Continuation-in-part of application No. 10/930,021, filed on Aug. 30, 2004, now abandoned, which is a continuation of application No. 10/413,200, filed on Apr. 14, 2003, now Pat. No. 6,792,996, application No. 11/070,126, which is a continuation-in-part of application No. 10/427,829, filed on May 1, 2003, now Pat. No. 6,932,138.

(51) Int. Cl.
*E06B 9/303* (2006.01)

(52) U.S. Cl. ..... 160/176.1 R; 160/89; 160/84.04

(58) Field of Classification Search ..... 160/176.1 R, 160/173.1, 84.01, 84.04, 84.05, 84.06, 89, 160/178.3

See application file for complete search history.

(56) References Cited

U.S. PATENT DOCUMENTS

| | | | | |
|---|---|---|---|---|
| 4,069,857 | A | 1/1978 | Brookshire | 160/84 |
| 4,108,698 | A | 8/1978 | Brookshire | 156/60 |
| 4,921,032 | A | 5/1990 | May | 160/84.1 |
| 5,129,440 | A | 7/1992 | Colson | 160/84.1 |
| 5,375,642 | A | 12/1994 | Gaber et al. | 160/168.1 |
| 5,425,408 | A | 6/1995 | Colson | 160/84.07 |
| 5,566,735 | A | 10/1996 | Jelic | 160/84.4 |
| 5,603,368 | A | 2/1997 | Colson | 160/84.05 |
| 5,690,156 | A | 11/1997 | Ruggles | 160/84.04 |
| 5,787,951 | A | 8/1998 | Tonomura et al. | 160/84.01 |
| 6,029,734 | A | 2/2000 | Wang et al. | 160/170 |
| 6,354,353 | B1 * | 3/2002 | Green et al. | 160/84.04 |
| 6,688,370 | B1 * | 2/2004 | Nien | 160/121.1 |
| 6,792,996 | B1 * | 9/2004 | Yu et al. | 160/176.1 R |
| 6,932,138 | B2 * | 8/2005 | Yu et al. | 160/84.01 |

FOREIGN PATENT DOCUMENTS

DE 28 44 891 A1 4/1980

* cited by examiner

*Primary Examiner*—David Purol
(74) *Attorney, Agent, or Firm*—Olson & Cepuritis, Ltd.

(57) ABSTRACT

An improved Venetian blind type window covering having an open position and a closed position is provided. The window covering includes a plurality of panels suspended between a head rail and a bottom rail that provides a generally billowed appearance. A securement member and an adjustment member, in cooperation, are suitable for adjustably moving or tilting the plurality of blind panels to open and close the window covering. A tilting mechanism causes positional adjustment of the plurality of panels by raising and lowering at least the adjustment member.

20 Claims, 8 Drawing Sheets

VENETIAN BLIND

This is a continuation-in-part application of U.S. Ser. No. 10/930,021, filed on Aug. 30, 2004, now abandoned which is a continuation of U.S. Ser. No. 10/413,200, filed on Apr. 14, 2003, now issued as U.S. Pat. No. 6,792,996. This is also a continuation-in-part of U.S. Ser. No. 10/427,829, filed on May 1, 2003 now U.S. Pat. No. 6,932,138. Each of these patents and applications are hereby incorporated by reference.

TECHNICAL FIELD OF THE INVENTION

This invention relates to an improved window covering. More particularly, this invention relates to an improved window covering of the Venetian blind type comprising a plurality of slats or panels, wherein one side of the shade is typically arranged to face the interior of a room.

BACKGROUND OF THE INVENTION

A Venetian blind is widely welcomed as a window covering because it provides the functions of blocking sun rays, adjusting indoor brightness, decorating rooms, providing privacy, etc. A conventional Venetian blind typically includes a head rail, a bottom rail, a plurality of slats, a raising mechanism including multiple raising cords, and a tilting or adjustment mechanism including multiple ladder strings. The lifting member typically comprises cords that are laterally symmetrically provided on the blind to balance the bottom rail and the slats for them to be lowered or lifted synchronously. By pulling the raising cords, the bottom rail and the slats are lifted or lowered relative to the head rail as desired.

A Venetian blind also offers the ability to permit light into a room without lifting the entire blind by tilting the slats. The slats can be tilted upward or downward through operation of the tilting mechanism which adjusts the ladder strings. In this regard, each ladder generally includes a front and rear, and vertically-extending members or strings connected to each other by a plurality of vertically-spaced cross-rungs. Supported on each cross-rung, between the vertically extending members of its ladder, is a slat, such as a narrow aluminum strip or wooden board. The head rail generally includes this tilting or adjusting mechanism for moving the ladders, so that the vertically-extending members of each ladder move in opposite vertical directions relative to one another, to pivot each slat about its length-wise axis. By tilting the above-mentioned slats to a different angle of inclination, the amount and direction of light projected into a room through the Venetian blind can be controlled and adjusted.

Another form of window covering is commonly referred to as a Roman shade. Unlike the Venetian blind which is formed of slats and presents sharp uniform aesthetic lines, a Roman shade provides a cascading softer appearance. The present invention offers a window covering having the softer appearance of curved panels which are opened and closed in a manner similar to the Venetian blind of U.S. Ser. No. 10/413,200.

SUMMARY OF THE INVENTION

An improved Venetian blind type window covering having a softer aesthetic appearance is provided. The window covering is moveable from a closed position to an open position, and includes a face, a head rail having a tilting mechanism for raising and lowering at least one adjustment member, a securement member operatively connecting the head rail and a bottom rail, and a plurality of panels between the head rail and the bottom rail, where each of the panels is restrainedly positioned at a spaced row interval with the securement member and the adjustment member. Each of the plurality of panels includes a first longitudinal portion and an opposed second longitudinal portion. The panel is folded over itself such that first longitudinal portion and the opposed second longitudinal portion are in an overlapping relationship. The panel, when folded defines a distal end portion extending from the adjustment member that has a curved appearance. Each of the plurality of panels is preferably formed of a flexible material, such as fabric, film, laminate, or the like. Each of the plurality of panels is pivotally biased towards the distal end portion. The tilting mechanism is suitable for opening or closing the plurality of panels by raising or lowering the adjusting member independent of the securement member.

In one embodiment, the distal end portion for each of the panels is longer than the row interval such that when the window covering is in the closed position, the securement member and the adjustment member are concealed from the face by a distal end portion of an adjacent panel. In other words, the panel of one row will partially overlap with an adjacent row such that visible gaps between the rows are not present. Alternatively, the distal end portion for each of the panels may be shorter than the row interval such that when the window covering is in the closed position, the securement member and the adjustment member are partially visible.

It is preferred that the securement member and the adjustment member are cords. It is further preferred that each of the cords include a plurality of spaced loops. As such, the first and second longitudinal portions of each of the panels is detachably secured to the cords by an anchor member positioned with the longitudinal portion which guided through one of the spaced loops.

A tilting mechanism is also included in the head rail for raising and lowering at least the adjustment member. The tilting mechanism, in some embodiments, may also raise and lower the securement member. The tilting mechanism causes positional adjustment of the plurality of panels by raising and lowering at least the adjustment member. At least the securement member connects the head rail and a bottom rail with the plurality of panels positioned therebetween. Each of the plurality of panels is restrainedly positioned along the securement member at a row interval. The row interval is the distance between adjacent rows as measured along the securement members, and is preferably uniform for the entire window covering.

A number of cooperating forces are applied to each of the plurality of panels. A gravitational closing force is applied about the center of gravity of each of the panels. This gravitational closing force urges the front or distal end portion of the panels to move downwards towards a closed position. A countervailing lifting force is applied to each of the panels by the adjustment member which tends to cause the panels to tilt upwards and to open. A further counterbalancing force is applied to each of the panels by the securement member. This counterbalancing force is preferably greater than the lifting force.

The gravitational closing force is a constant downward force, which is offset by and at equilibrium with the lifting force when the position of the plurality of panels is stationary. When the adjustment member is extended by the tilting mechanism in the head rail, the lifting force is decreased such that the gravitational force overcomes the lifting force and the panels are tilted towards a closed position. By contrast, when the adjustment member is retracted by the tilting mechanism in the head rail, the lifting force is greater than the gravitational closing force so the panels are tilted upwards or opened.

The counterbalancing force is, however, greater than either of the gravitational force or the lifting force so panels pivot about a longitudinal region proximal to the front or distal end portion. Where only the adjustment member is raised and lowered, the counterbalancing force is sufficiently great such that the longitudinal region about which the panels pivot is preferably located approximately about the point at which the securement member is restrainedly positioned with the panels and the longitudinal region extending therefrom. This pivot region remains substantially vertically stationary relative to the head rail when the tilting mechanism raises and lowers the adjustment member. Providing a sufficient counterbalancing force can be accomplished in several manners. For example, the bottom rail to which the securement member is connected can be of a sufficiently heavy weight to overcome the lifting force that may be applied to the panels. Alternatively, each panel may include a weighted strip on a proximal end to cause the center of gravity of the panel to shift closer to the longitudinal region such that the force applied to the center of gravity is lessened.

As discussed, in some embodiments, the securement member can also be raised and lowered by the tilting mechanism. In particular, the tilting mechanism raises and lowers the securement and adjustment members in opposite vertical directions relative to one another, to pivot each panel about a longitudinal region proximal to the front or distal end portion.

DESCRIPTION OF THE PREFERRED EMBODIMENT OF THE INVENTION

Figure 1:
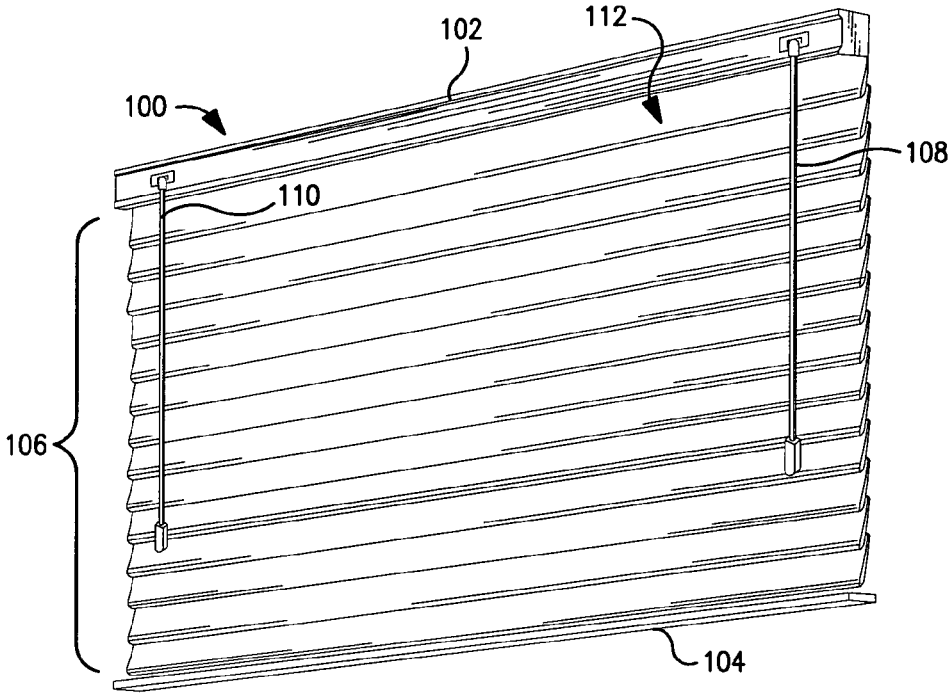
FIG. 1 is a perspective front view of a preferred embodiment of a closed window covering according to the present invention.

The invention disclosed herein is susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

A preferred embodiment of the present invention is shown in FIG. 1. Window shade 100 includes a head rail 102, a bottom rail 104, and a plurality of blind slats 106. Also provided is a tilting control wand 108 for actuating the tilting mechanism (not shown) in the head rail 102 to open or close the blind slats 106. A raising cord 110 extending between the head rail 102 and the bottom rail 104 is for raising the entire shade 100. The window shade 100 presents, on a face side 112, an appearance that is free of cords or other components connecting the plurality of slats 106, which would otherwise disrupt the aesthetic appearance of the window covering.

Although not shown in detail in the figures, the tilting mechanism can be any device for controllably raising and lowering a cord such as commonly found in Venetian blinds. For example, in an embodiment with a control wand, such as control wand 108 in FIG. 1, the control wand may simply comprise a worm gear for turning a spool upon which a cord is wound to raise the cord, or unwound to lower the cord. Alternatively, the tilting mechanism may be a cord lock whereby the user merely pulls on an adjustment cord to tilt and open the blind slats to a desired position and the cord is then locked in place. Such cord locks are often found in assemblies for raising an entire shade. Other mechanisms for controllably raising or lowering a cord as are known in the art may also be utilized.

Figure 2:
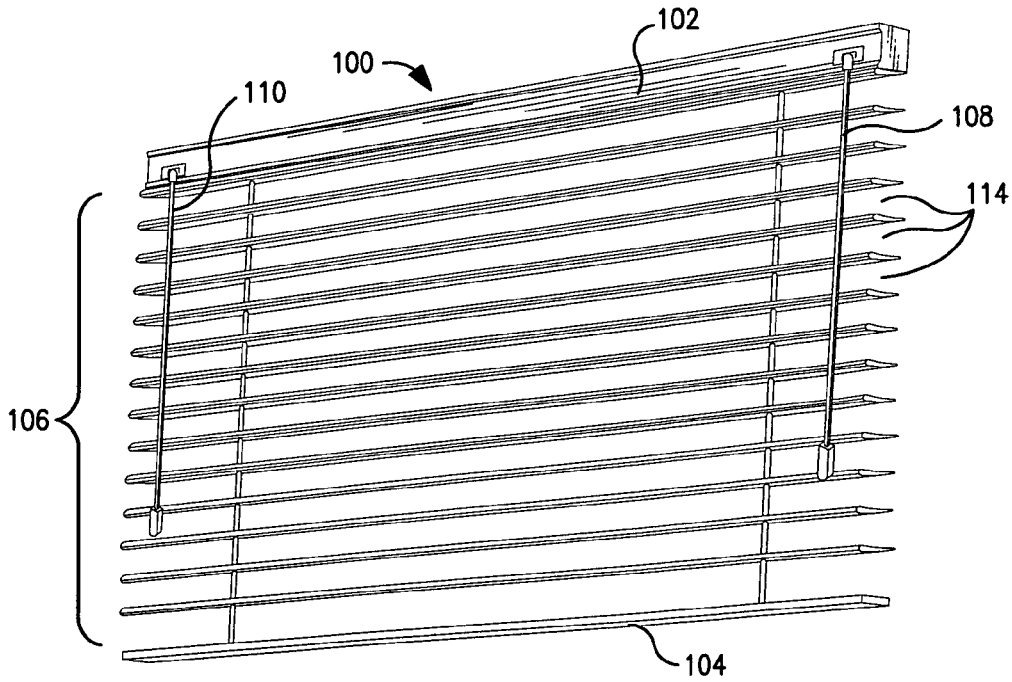
FIG. 2 is a perspective front view of the window covering of FIG. 1 partially open.

In a closed position, such as shown in FIG. 1, the window covering 100 offers a uniform uninterrupted appearance providing both privacy and light blocking. If it is desired to allow light into a room without raising the entire shade, and thereby retaining some degree of privacy, a user can rotate the tilting control wand 108. As the tilting control wand 108 is rotated and adjustment member 122 (FIG. 3) is raised, the angle of each of the plurality of slats 106 is adjusted such that gaps 114 in the window shade 100 are opened as shown in FIG. 2. The particular arrangement of each of the plurality of slats is discussed in further detail below.

Figure 3:
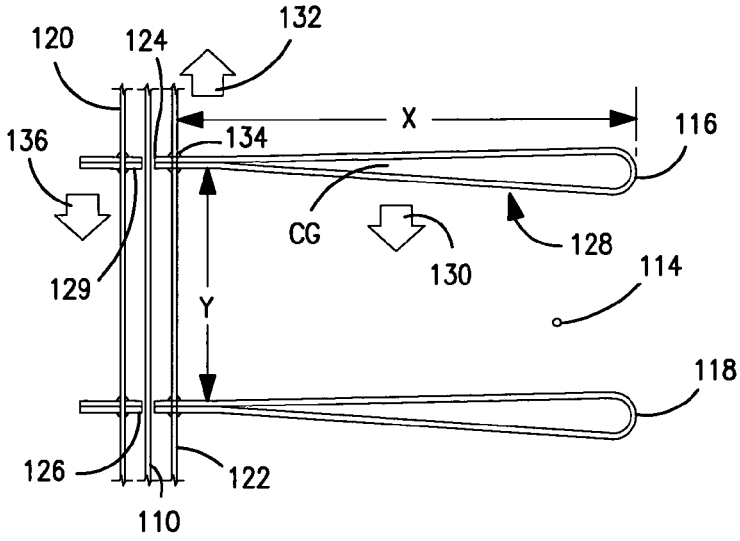
FIG. 3 is a cross sectional side view of a pair of adjacent blind slats of FIG. 1 partially opened.

Referring to FIG. 3, one embodiment for the arrangement of slats 116 and 118 is explained to demonstrate the arrangement of each of the plurality of slats in window covering 100. In this embodiment, securement member 120 and adjustment member 122 are each passed through and secured to slats 116 and 118. Slats 116 and 118 are fixedly secured to the securement member 120 and the adjustment member 122 by way of adhesive, ultrasonic welding, knitting, tying, or the like. As discussed in further detail below, the securement member 120 and adjustment member 122 may alternatively be restrainedly positioned with the blind slat through use of a plastic strip extending longitudinally along the blind slats to which the securement member 120 and adjustment member 122 are secured.

In this embodiment, the securement member 120 and adjustment member 122 are shown passing through slats 116 and 118. It is contemplated, however, that the securement member and adjustment member can be a series of cords, wherein each cord connects two adjacent slats.

Slats 116 and 118 also define holes 124 and 126 through which is passed raising cord 110. While the cords 110, 120 and 122 are shown to be co-planar, this is not required. The relative positions of the securement member 120 and the adjustment member 122 are such that one is positioned distal to the other. As shown, the adjustment member 122 is positioned distal to the securement member 120, however, the positions of the adjustment member 122 and securement member 120 can be reversed such that the securement member 120 is positioned distal to the adjustment member 122. In this alternate embodiment, the blind slats are opened by lowering the adjustment member and are closed by raising the adjustment member.

A row interval is shown as Y and a center of gravity for slat 116 is depicted as CG. The width of the front or distal end portion 128 of slat 116 is indicated as X extending from the adjustment member 122. While only one set of cords, i.e., securement member 120, adjustment member 122, and raising cord 110, is shown in FIG. 3, it is preferred that a pair of sets of cords of similar configuration be equidistantly spaced from opposing sides of the window shade as shown in FIG. 2. The edge portion of slat 116 opposite the front edge portion 128 is the rear edge portion 129 to which securement member 120 and adjustment member 122 are secured.

In operation, various forces are applied to the blind slats. Blind slat 116 is discussed by way of example. The gravitational force effectively applied to center of gravity CG is shown as force arrow 130. A lifting force which is depicted as force arrow 132 is also applied to blind slat 116 by adjustment member 122 at the region where blind slat 116 is fixed to adjustment member 122. A counterbalancing force which is shown as force arrow 136 is applied to blind slat 116 by securement member 120 at the region where blind slat 116 is fixed to securement member 120. When it is desired to adjust the angle of the blind slats, the tilting mechanism is preferably controlled by the tilting control wand 108 (FIG. 1). Turning the tilting control wands causes the tilting mechanism in the head rail to extend or retract the adjustment member 122 and thereby adjust the angle of the blind slats. Extending the adjustment member 122 reduces the force 132 such that the gravitational force 130 causes the blind slat 116 to move downwards, whereas retracting the adjustment member 122 increases the force 132 and overcomes the gravitational force 130 and raises the distal end portion 128 and thereby tilts blind slat 116 upwards. As stated, counterbalancing force 136 is greater than lifting force 132 even when adjustment member 122 is being retracted such that the point at which the securement member 120 is fixed to the slat 116 and the longitudinal region extending therefrom remains vertically stable relative to the head rail during any adjustment of the angle of the blind slats.

The width of front or distal end portion 128, denoted as X, is greater than the row interval distance which is indicated as Y. As such, when adjustment member 122 is extended such that front or distal end portion 128 of blind slat 116 is lowered to contact adjacent blind slat 118, hole 126, adjustment member 122, and securement member 120 are concealed from the face of the window covering, when viewed from one direction, by front or distal end portion 128.

Figure 4:
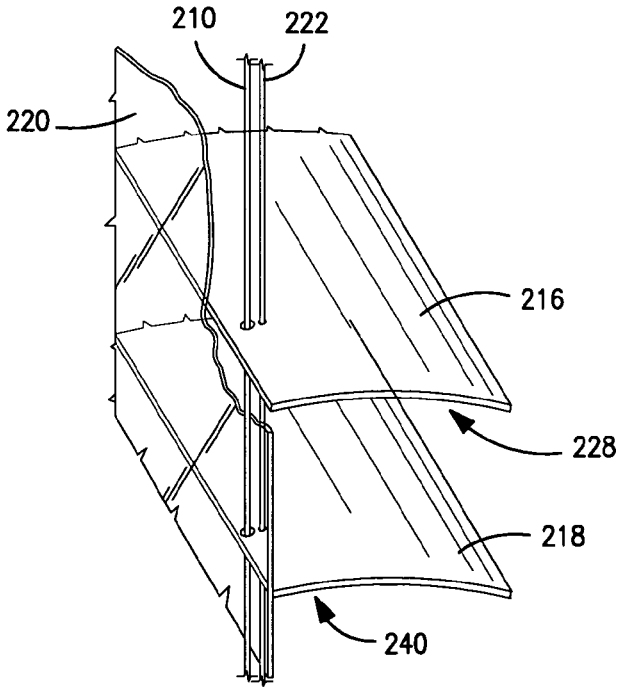
FIG. 4 is a perspective side view, partially in section, of a pair of adjacent blind slats according to an alternate embodiment of the window covering.

An alternate embodiment of the improved window covering is shown as FIG. 4. Again, reference is made to a pair of blind slats 216 and 218 as exemplary of the plurality of blind slats in the window covering. This embodiment is similar to the previous embodiment except that instead of a cord being utilized as a securement member 220, a panel of material is provided. Also provided are adjustment member 222 and raising cord 210. Securement member 220 may be a panel extending the entirety of the window covering, and which may be comprised of a semitransparent material. With such an arrangement, blind slats can be tilted to permit light to enter a room, but still maintain a high degree of privacy. If desired, the panel can be opaque, transparent, or include a design. It is preferred that a pair of sets of cords 222 and 210, i.e., adjustment member 222 and raising cord 210, be equidistantly spaced from the edges of the window covering.

The overall operation of the embodiment shown in FIG. 4 is the same as discussed with respect to the embodiment shown in FIG. 3. As adjustment member 222 is raised or lowered, blind slats 216 and 218 are opened or closed, respectively. Again, rear edge portion 240 of adjacent slat 218 about which adjustment member 222 and securement member 220 are restrainedly positioned are concealed by the front edge portion 228 of blind slat 216 as it overlaps the rear edge portion 240 of adjacent slat 218 when the window covering is in a closed position.

Figure 5:
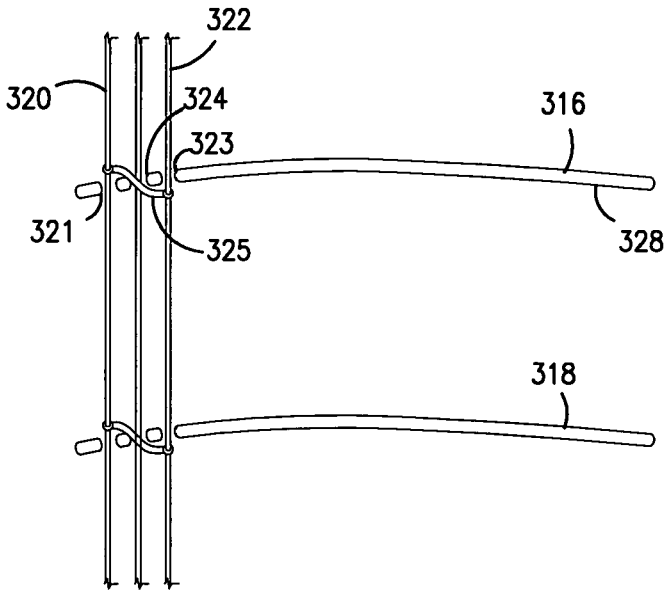
FIG. 5 is a cross section side view of a pair of adjacent blind slats according to another alternate embodiment of the window covering.

Another embodiment of the improved window covering is shown in FIG. 5. The arrangement of slats 316 and 318 is again provided to demonstrate the configuration of each of the plurality of slats. In this embodiment, securement member 320 and adjustment member 322 are passed through holes 321 and 323, respectively. Unlike the embodiment shown in FIG. 3, the securement member 320 and adjustment member 322 are not fixedly secured to blind slats 316 and 318. Instead, referring to slat 316, securement member 320 and adjustment member 322 are restrainedly positioned by being restricted in their movement by ladder rung 325, which comprises a string or cord secured to adjustment member 322 below slat 316 and secured to securement member 320 above slat 316. Ladder rung 325 is further passed through hole 324, through which raising cord 310 is also passed. Ladder rung 325 restricts the upward movement of the blind slat 316 along securement member 320 and restricts the downward movement along adjustment member 322. Similar to the embodiment shown in FIG. 3, it is preferred that a pair of cord sets comprising the securement member 320, the adjustment member 322, the raising cord 310, and the ladder rung 325 be included, and be spaced equidistantly from opposing sides of the window covering.

Thus far, in each of the embodiments provided, the securement member remains stationary relative to the head rail, while the adjustment member is raised and lowered. An alternate embodiment wherein both the securement member and adjustment member are raised or lowered may also be utilized. In particular, as adjustment member 322 is raised, securement member 320 is lowered, and similarly as adjustment member 322 is lowered, securement member 320 is raised. The tilting mechanism for this embodiment can be any mechanism that can simultaneously raise one cord while lowering another. For example, the tilting mechanism found in standard Venetian blinds for raising and lowering the front and rear of a ladder assembly is suitable. As with the previous embodiment, when the window shade is in a closed position no cords or ladders are visible from the face because the front or distal end of the slats, such as front or distal end 328, overlaps the lower adjacent slat.

Figure 6:
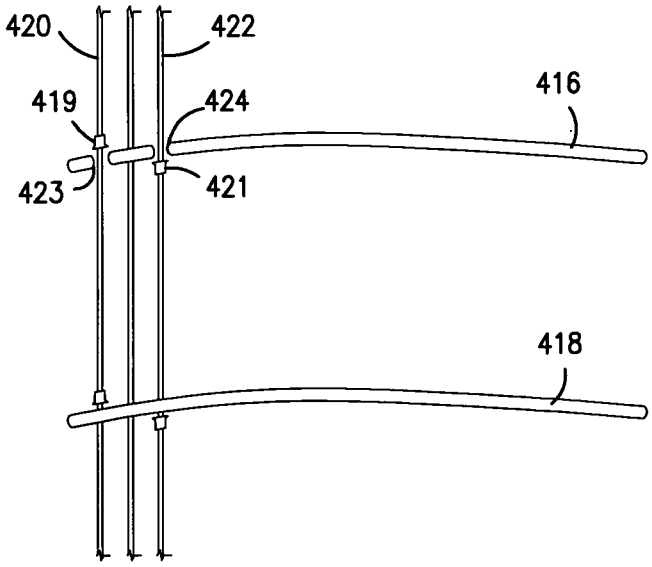
FIG. 6 is a side view of a pair of adjacent blind slats according to yet another alternate embodiment of the window covering.

Yet another method for restrainedly positioning the blind slats relative to the securement member and adjustment member is shown in FIG. 6. Securement member 420 and adjustment member 422 are passed through holes 423 and 424, respectively. In order to restrainedly position blind slats 416 and 418 relative to securement member 420 and adjustment member 422, a stop 419 and a rest 421 are fixedly secured to securement member 420 and adjustment member 422, respectively. Stop 419 is configured such that a portion thereof adjacent to the slat 416 is larger than hole 423. Rest 421 is similarly configured to include a portion larger than hole 424. Accordingly, stop 419 restricts the upward movement of the blind slat 416 along the securement member 420 and rest 421 restricts the downward movement along adjustment member 422. The opening and closing of the window covering through tilting the slats is as discussed above in previous embodiments.

Figure 7:
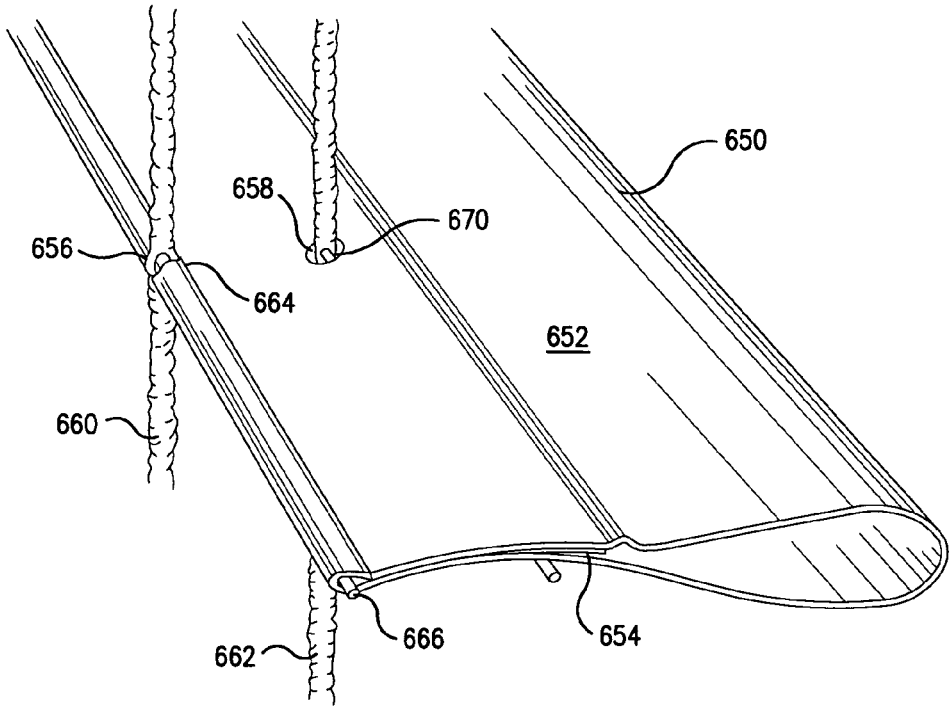
FIG. 7 is an enlarged perspective view of a preferred embodiment of fixedly securing the blind slats to the securement member and the adjustment member.
Figure 8:
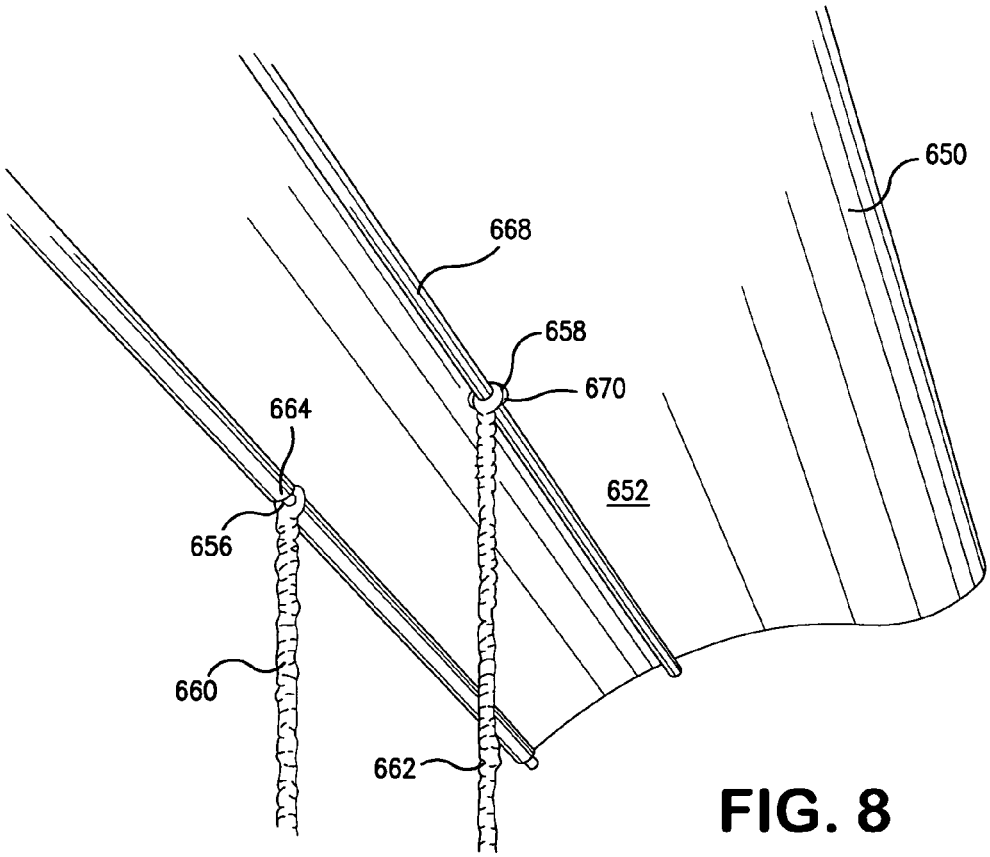
FIG. 8 is an enlarged bottom view of the embodiment of FIG. 7.

As discussed above, the securement member and the adjustment member can be restrainedly positioned with the plurality of blind slats in a variety of ways. Shown in FIGS. 7 and 8 is one preferred embodiment utilizing a plastic strip. Blind slat 650 comprises a piece of material 652 that is folded upon itself such that its opposing edge sandwich a reinforcing strip 654. Material 652 defines holes 656 and 658 and are sized to permit securement member 660 and adjustment member 662, respectively. Formed with securement member 660 is loop 664. A rigid securement strip 666 that is preferably formed of plastic is also sandwiched by the opposing edges of material 652 about a proximal edge of the blind slat 650. Rigid securement strip 666 intersects with hole 656 and is passed through loop 664. As such, securement member is secured to blind slat 650. Referring to FIG. 8, loop 670 is similarly formed with adjustment member 662. Rigid securement strip 668 is passed through loop 670 formed in adjustment member 662, which is passed through hole 658. Rigid securement strip 668 is positioned below blind slat 650. As such, blind slat 650 is restrainedly positioned with adjustment member 662 and plastic strip 668 because the downward movement of the slat 650 relative to the adjustment member 662 is restricted by the strip 668. If desired, the strip 668 can be fixedly secured to the slat 650, such as by an adhesive.

Figure 9:
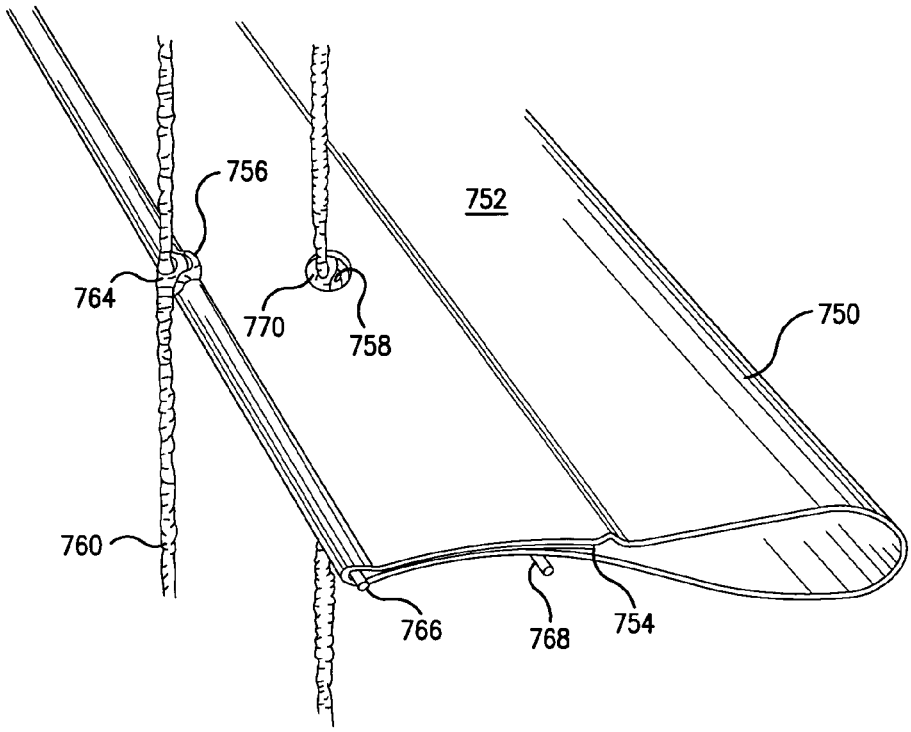
FIG. 9 is an enlarged perspective view of another preferred embodiment of fixedly securing the blind slats to the securement member and the adjustment member.
Figure 10:
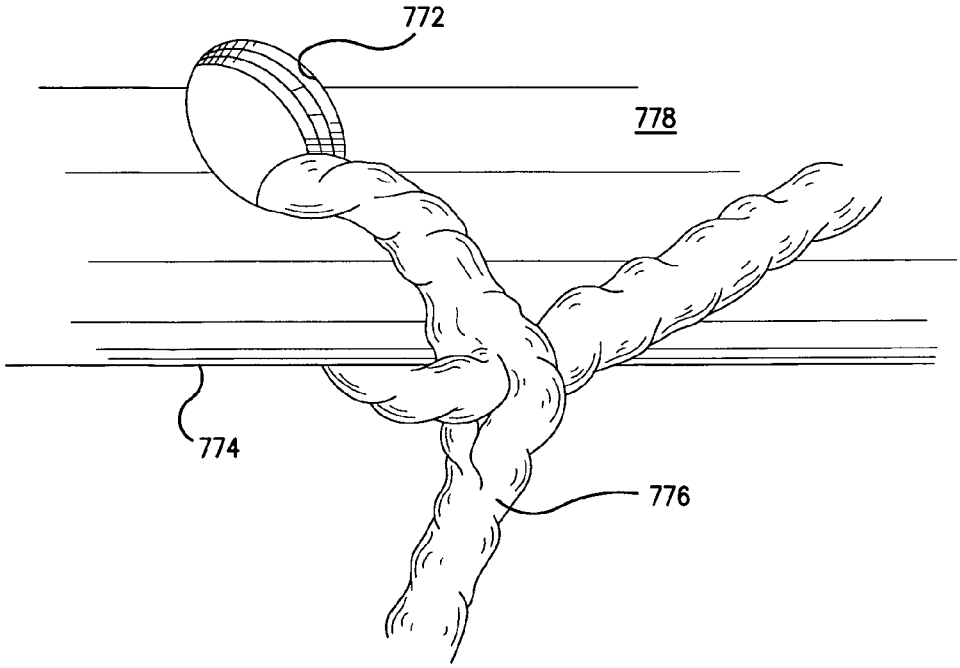
FIG. 10 is an enlarged view of another alternative embodiment of fixedly securing blind slats to a securement member.

Yet another way of restrainedly positioning the blind slats and the securement and adjustment members is shown in FIGS. 9 and 10. In this embodiment, blind slat 750 comprises a piece of material 752 that is folded upon itself such that its opposing edge sandwiches a reinforcing strip 754. Securement member 760 and adjustment member 762 pass through holes 756 and 758, respectively. Similar to the previous embodiment, each of the securement member 760 and adjustment member 762 are formed with loops 764 and 770, respectively. The securement member 760 and adjustment member 762 are each passed through the loop and secured to plastic strips 766 and 768. Alternatively, a hole 772 can be formed adjacent from but not coincident with edge 774 such that, in this case, the securement member 776 is tied to the blind slat 778 directly, as shown in FIG. 10. In such an embodiment, no plastic securement strips are needed, but may be included if desired.

Figure 11:
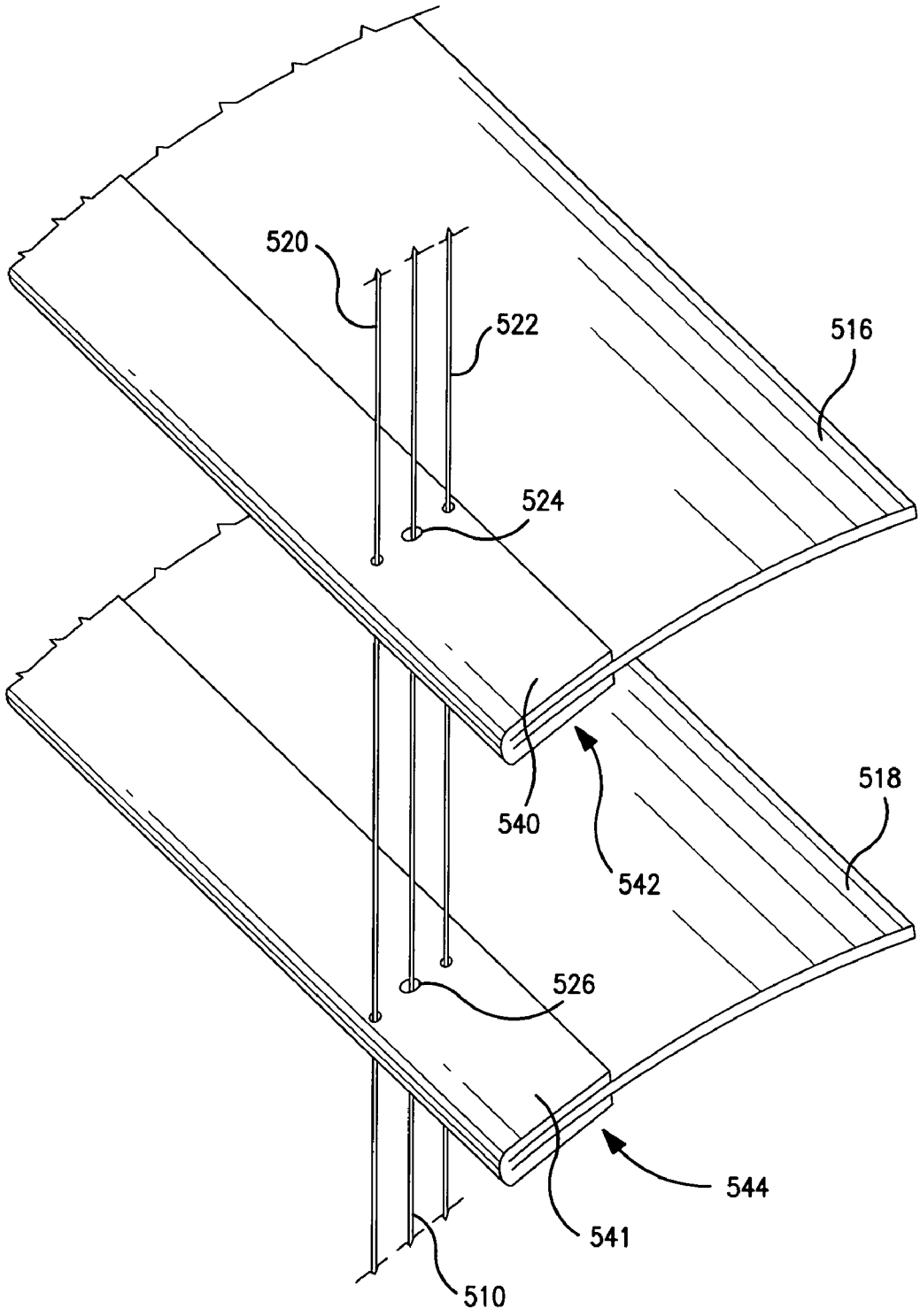
FIG. 11 is a perspective view of a pair of adjacent blind slats according to a further embodiment of the window covering.

An optional feature that may be included in any of the embodiments is a reinforcing strip as shown in FIG. 11. In this embodiment, securement member 520 and adjustment member 522 are each passed through and secured to slats 516 and 518. Slats 516 and 518 are fixedly secured to the securement member 520 and the adjustment member 522 and also define holes 524 and 526 through which is passed raising cord 510. Reinforcing strip 540, such as a thin metal stip or the like, is also included. The reinforcing strips 540 and 541 enhance the securement between the securement member 520 and the slats 516 and 518. Reinforcing strips 540 and 541 may also serve the further purpose of providing additional weight on the proximal end portion 542 and 544 of slats 516 and 518, respectively. In so doing, the center of gravity of the slats is shifted closer to the proximal end portions 542 and 544, which lessens the required amount of counterbalancing force to be applied by the securement member 520, such as provided by the weight of the bottom rail. It is preferred that the reinforcing strips 540 and 541 extend the length of the slats, however, it is possible for a strip to only extend a portion of the slats.

Figure 12:
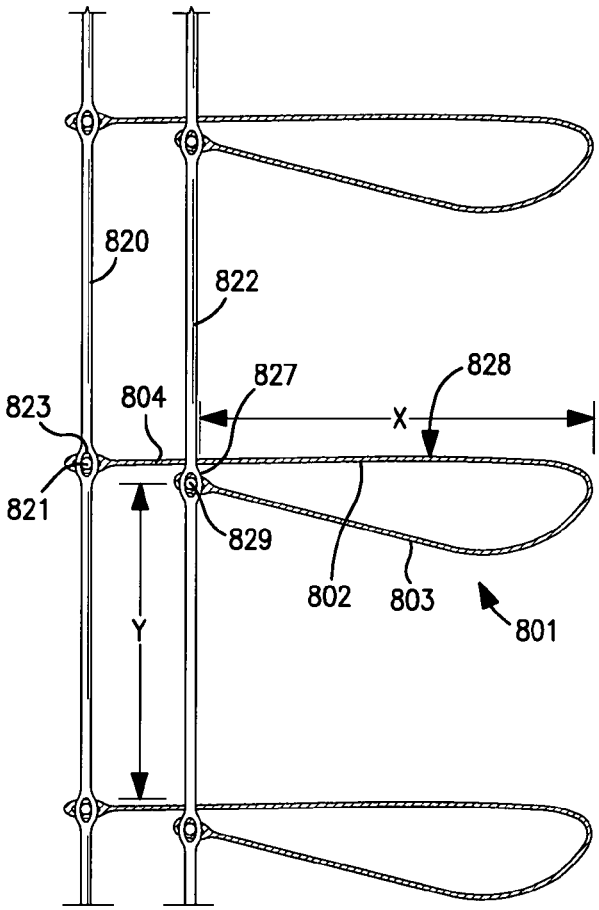
FIG. 12 is a cross sectional side view of adjacent folded panels of an alternative embodiment of a window covering in the opened position.

In other preferred embodiments such as that depicted in FIG. 12, the traditional blind slats can be replaced with rows of folded panels, such as panel 801. Each of these panels can be made from any number of materials, including but not limited to plastic, fabric, laminate, or paper. Each panel 801 is folded upon itself, forming a first portion 802, which in this embodiment is the top section of the folded panel, and a second portion 803, which in this embodiment is the bottom section of the folded panel. The part of the panel 801 that extends distally from the adjustment member 822 forms the distal end portion 828, and has a width as indicated by X. In this embodiment, the width of the distal end portion 828 is greater than the row interval denoted as Y.

While the panel 801 may be folded with a crease, the panel 801 is preferably soft folded with a gentle curve as shown to create a more aesthetically pleasing look such as depicted. The use of panels 801 that have been soft folded with a gentle curve is advantageous in that the window covering operationally behaves as a Venetian blind yet retains the pleasing aesthetics of a Roman shade. In this embodiment, the panel 801 is folded in an asymmetrical manner such that such that the first portion 802 is wider than the second portion 803. It should be understood however that the first portion 802 and the second portion 803 may be substantially symmetrical.

The movement of the panels is similar to the movement of the slats discussed in the previous embodiments. The securement member 820 and adjustment member 822 are secured to the panel 801. In the embodiment shown in FIG. 12, the adjustment member 822 passes through a hole 804 of the folded panel 801. Although not shown, a tilting mechanism may be used to controllably raise or lower the adjustment member 822 relative to the securement member 820, causing the panel to tilt. The relative positions of the first portion 802 and the second portion 803 are maintained by the weight of the panel. In other words, the gravitational force from the weight of the panel urging the panels 801 to move downward towards a closed position is counterbalanced by a lifting force applied to the panel 801 by the securement member 820 and adjustment member 822.

In this embodiment, the securement member 820 and adjustment member 822 are formed with loops through which an anchor member 821 detachably secures the panel 801 to the securement member 820 and adjustment member 822 in a manner similar to that described above in relation to FIGS. 7 and 8. For example, anchor member 821 is guided through one of the spaced loops defined by securement member 820, such as loop 823. The anchor member 821 is also guided through a loop 825 defined by the first portion 802. Similarly, the adjustment member 822 includes a plurality of spaced loops, such as loop 827, through which anchor member 829 is passed. Alternatively, the securement member 820 or the adjustment member 822 can be secured to the folded panels 801 by way of a fastener module to further facilitate removal or interchanging of panels, such as those suggested in U.S. application Ser. No. 10/970,428, for FASTENER MODULE FOR A WINDOW COVERING AND METHOD, filed on Oct. 21, 2004 by Fu-Lai Yu; Chin-Tien Huang; and Shun-Chi Yu, hereby incorporated by reference.

Figure 13:
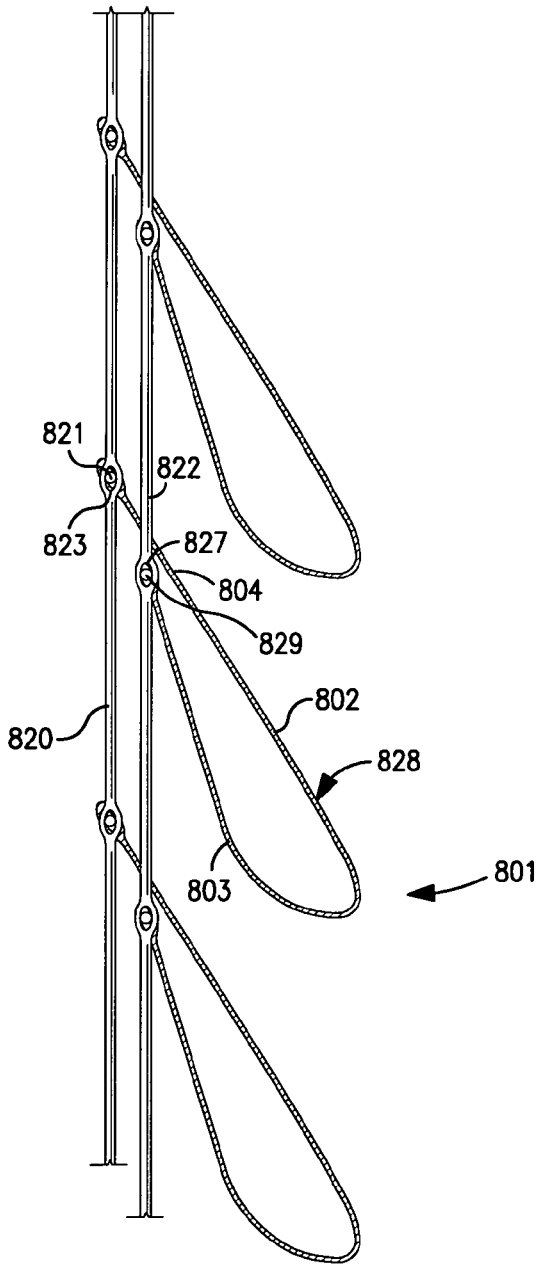
FIG. 13 is a foreshortened side view of the window covering of FIG. 12 in the closed position.

FIG. 13 shows the embodiment of FIG. 12 in the closed position. As shown, when in the closed position, the distal portion 828 of panel 810 conceals the securement member 820 and adjustment member 822 by overlapping with the adjacent row. It may also be desirable to stiffen or reinforce at least part of the distal end portion 828 to prevent the panel 801 from sagging when in the open position. Stiffening of the desired portions can be accomplished through a number of methods, including by way of example the use of reinforcing strips, use of more rigid materials, sturdier weaving techniques, stiffening coatings or sprays, or the like.

Figure 14:
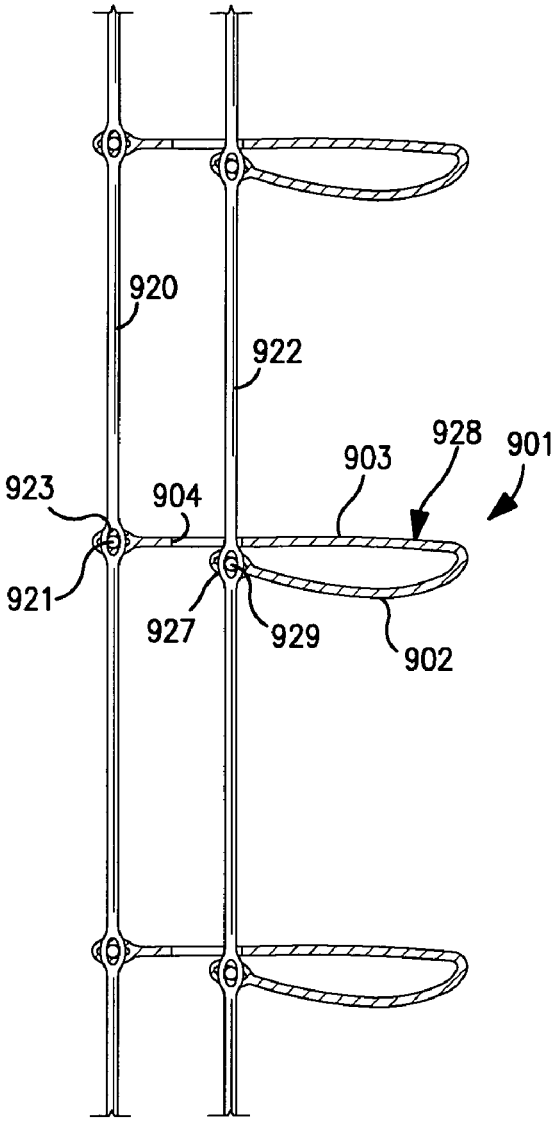
FIG. 14 is a cross sectional side view of adjacent folded panels of another alternative embodiment of a window covering in the opened position.
Figure 15:
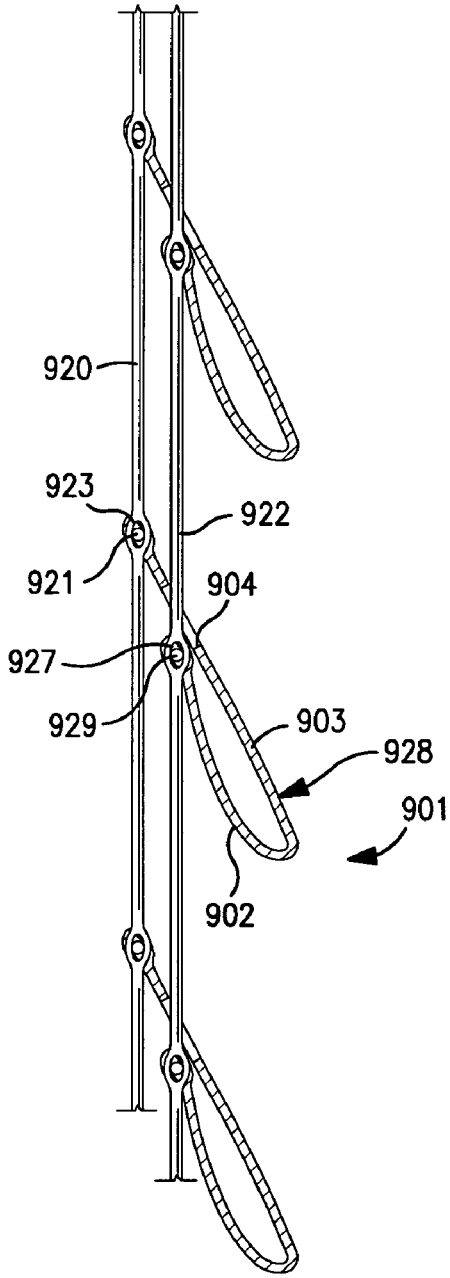
FIG. 15 is a foreshortened side view of the window covering of FIG. 14 in the closed position.

Thus far the embodiments described have included rows that conceal the control members when the window covering is in the closed position. Referring to FIGS. 14 and 15, an alternate embodiment is described. Similar to the previous embodiment, the blind slats are replaced with rows of folded panels, such as panel 901. Each panel 901 is folded upon itself such that first portion 902 is folded over and overlaps with second portion 903. The distal end portion 928 of panel 901 extends distally from the adjustment member 922. The width of the distal end portion 928 preferably is slightly less than the row interval denoted as Y.

The adjustment member 922 passes through a hole 904 defined by the first portion 902 of the folded panel 901. As before, the relative positions of the first portion 902 and the second portion 903 are maintained by the weight of the panel, i.e., the gravitational force from the weight of the panel urging the panels 901 to move downward towards a closed position is counterbalanced by a lifting force applied to the panel 901 by the securement member 920 and adjustment member 922, which passes through hole 904 defined by securement member 920. The securement member 920 and adjustment member 922 are formed with loops. For example, securement member 920 defines a loop 923, and adjustment member 922 defines loop 927. Anchor member 921 and anchor member 929 are guided through loops 923 and 927, respectively. Since the distal end portion 928 is shorter than the row interval Y, when in the closed position, the securement member 920 and adjustment member 922 are partially visible from the face.

The foregoing descriptions are to be taken as illustrative, but not limiting. Still other variants within the spirit and scope of the present invention will readily present themselves to those skilled in the art.

What is claimed is:

1. A window covering having a closed position, an open position, and a face, and comprising:

a head rail having a tilting mechanism for raising and lowering at least one adjustment member;

a securement member operatively connecting the head rail and a bottom rail;

a plurality of panels between the head rail and the bottom rail, each of the panels restrainedly positioned at a spaced row interval with the securement member and the adjustment member, each of the plurality of panels having a first longitudinal portion and an opposed second longitudinal portion the first longitudinal portion being greater in length than the second longitudinal portion;

each of the panels being folded upon itself to define a first longitudinal portion and a second longitudinal portion overlapping with each other, thereby forming a curved distal end portion extending from the adjustment member and opposite to a first rear edge portion of the first longitudinal portion and a second rear edge portion of the second longitudinal portion, wherein the adjustment member is secured with each panel at one of the first or second rear edge portion and the securement member is secured with each panel at the other one of the first or second rear edge portion; and the tilting mechanism being operable to raise and lower the adjustment member independent of the securement member and rotate a first longitudinal portion of each of the plurality of panels between the closed position and the open position.

2. The window covering of claim 1, wherein the distal end portion for each of the panels is longer than the row interval such that when the window covering is in the closed position, the securement member and the adjustment member are concealed from the face by a distal end portion of an adjacent panel.

3. The window covering of claim 1, wherein the distal end portion for each of the panels is shorter than the row interval such that when the window covering is in the closed position, the securement member and the adjustment member are partially visible.

4. The window covering of claim 1, wherein the securement member is a cord.

5. The window covering of claim 4, wherein the securement cord includes a plurality of spaced loops and is restrainedly positioned with each of the plurality of panels about the first longitudinal portion of each of the panels by an anchor member guided through one of the spaced loops.

6. The window covering of claim 1, wherein a counterbalancing force is applied to the plurality of panels, the counterbalancing force being greater than a lifting force applied to each of the panels by the adjustment member.

7. The window covering of claim 1, wherein at least part of the distal end portion is stiffened.

8. A window covering having an open position and a closed position, the window covering comprising:

a head rail, a bottom rail, a plurality of panels positioned between the head rail and the bottom rail, an adjustment member, and a securement member;

the head rail including a tilting mechanism for raising and lowering the adjustment member independent of the securement member;

each of the plurality of panels being folded upon itself to define a first longitudinal portion and a second longitudinal portion overlapping each other, wherein the first longitudinal portion has a first rear edge portion restrainedly positioned with the adjustment member, and the second longitudinal portion has a second rear edge portion restrainedly positioned with the securement member, the first longitudinal portion being greater in length than the second longitudinal portion, and each of the panels defining a curved front edge portion opposite the first and second rear edge portion; and each of the panels further being movable from the open position to the closed position by vertically moving the adjustment member relative to the securement member and tilting the first longitudinal portion of each of the panels.

9. The window covering of claim 8, wherein the front edge portion for each of the panels is greater than or equal to a row interval between two adjacent panels such that when the window covering is in the closed position, the securement member and the adjustment member are concealed from the face by the front edge portion of an adjacent panel.

10. The window covering of claim 8, wherein the the front edge portion for each of the panels is shorter than the row interval such that when the window covering is in the closed position, the securement member and the adjustment member are partially visible.

11. The window covering of claim 8, wherein the securement member is a cord.

12. The window covering of claim 11, wherein the securement cord includes a plurality of spaced loops and is restrainedly positioned with each of the plurality of panels by an anchor member guided through one of the spaced loops.

13. The window covering of claim 8, wherein a counterbalancing force is applied to the plurality of panels, the counterbalancing force being greater than a lifting force applied to each of the panels by the adjustment member.

14. A window covering having an open position and a closed position, the window covering comprising:

a head rail, a bottom rail, a plurality of panels positioned between the head rail and the bottom rail, and a first cord member and a second cord member;

the head rail including a tilting mechanism for raising and lowering the first cord member independent of the second cord member;

each of the plurality of panels being folded upon itself to define a first longitudinal portion and a second longitudinal portion overlapping with each other, and where the first longitudinal portion is longer than the second longitudinal portion, the first longitudinal portion having a first rear edge portion detachably secured with the first cord member, and the second longitudinal portion having a second rear edge portion located below the first longitudinal portion and detachably secured with the second cord member, each of the panels defining a curved front edge portion opposite the first and second rear edge portion; and each of the panels further being movable from the open position to the closed position by vertically moving the first cord member relative to the second cord member and tilting the first longitudinal portion of each panel.

15. The window covering of claim 14, wherein the front edge portion for each of the panels is greater than or equal to a row interval between two adjacent panels such that when the window covering is in the closed position, the first and second cord members are concealed from the face by the front edge portion of an adjacent panel.

16. The window covering of claim 14, wherein the front edge portion for each of the panels is shorter than the row interval such that when the window covering is in the closed position, the front and second cord members are partially visible.

17. The window covering of claim 14, wherein the first and second cord members include a plurality of spaced loops, the first longitudinal portion of each of the panels being detachably secured with the first cord member by a first anchor member guided through one of the spaced loops; and the second longitudinal portion of each of the panels being detachably secured with the second cord member by a second anchor member guided through one of the spaced loops.

18. The window covering of claim 14, wherein a counterbalancing force is applied to the plurality of panels, the counterbalancing force being greater than a lifting force applied to each of the panels by one of the first or second cord member.

19. The window covering of claim 14, wherein the second rear edge portion is spaced apart from the first rear edge portion of each of the panels.

20. The window covering of claim 19, wherein the second rear edge portion is kept substantially adjacent to a central region of the first longitudinal portion when each panel is being tilted.

* * * * *

UNITED STATES PATENT AND TRADEMARK OFFICE

CERTIFICATE OF CORRECTION

PATENT NO. : 7,614,438 B2
APPLICATION NO. : 11/070126
DATED : November 10, 2009
INVENTOR(S) : Yu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1286 days.

Signed and Sealed this

Nineteenth Day of October, 2010

David J. Kappos

David J. Kappos
*Director of the United States Patent and Trademark Office*